US011445837B2

(12) United States Patent
Alt et al.

(10) Patent No.: US 11,445,837 B2
(45) Date of Patent: Sep. 20, 2022

(54) DISPLAY MOUNT FOR TOILET SEAT ASSEMBLY

(71) Applicant: Bemis Manufacturing Company, Sheboygan Falls, WI (US)

(72) Inventors: Kenneth Alt, Winnetka, IL (US); Mary Distl, Seneca, SC (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 48 days.

(21) Appl. No.: 16/866,946

(22) Filed: May 5, 2020

(65) Prior Publication Data

US 2020/0359810 A1 Nov. 19, 2020

Related U.S. Application Data

(60) Provisional application No. 62/847,671, filed on May 14, 2019.

(51) Int. Cl.

| | |
|---|---|
| ***A47F 7/00*** | (2006.01) |
| ***A47F 5/08*** | (2006.01) |
| *A47K 13/26* | (2006.01) |

(52) U.S. Cl.

CPC ..... *A47F 7/00* (2013.01); *A47F 5/0876* (2013.01); *A47K 13/26* (2013.01)

(58) Field of Classification Search

CPC ..... A47F 5/0876; A47F 7/00; A47K 13/24; A47K 13/242; A47K 13/245; A47K 13/26; A47K 13/28; A47K 13/12

See application file for complete search history.

(56) References Cited

U.S. PATENT DOCUMENTS

| | | | | |
|---|---|---|---|---|
| D136,323 | S | 9/1943 | Watson | |
| 3,116,527 | A * | 1/1964 | Springer | A47K 13/242 4/253 |
| 98,471 | A | 6/1964 | Rankin | |
| 3,151,743 | A * | 10/1964 | Reibold | A47F 7/00 211/13.1 |
| 3,431,004 | A * | 3/1969 | Schell | A47K 13/242 292/258 |
| D227,981 | S | 7/1973 | Rouge | |

(Continued)

OTHER PUBLICATIONS

Images of a display mount for a toilet seat, publicly available at least as early as May 13, 2018 (7 pages).

*Primary Examiner* — Patrick D Hawn

(74) *Attorney, Agent, or Firm* — Michael Best & Friedrich LLP

(57) ABSTRACT

A display is configured to be coupled to a shelving structure. The display includes a bracket having an upper portion. The upper portion includes a plurality of walls. The plurality of walls is configured to contact a member of the shelving structure to couple the bracket to the shelving structure. The bracket also includes a mounting portion extending below the upper portion. The mounting portion includes a surface configured to be recessed within the shelving structure when the plurality of walls contact the member of the shelving structure. The mounting portion also includes an aperture extending through the surface. The aperture is positioned below the plurality of walls of the upper portion and configured to receive a fastener that couples a toilet seat assembly to the bracket.

20 Claims, 6 Drawing Sheets

(56) References Cited

U.S. PATENT DOCUMENTS 4,060,861 A * 12/1977 Lawrence ..... A47K 13/24 4/253
4,145,771 A * 3/1979 Khazin ..... A47K 13/242 24/16 PB
4,395,784 A * 8/1983 Foster ..... A47K 13/12 292/228
4,479,273 A * 10/1984 Raden ..... A47K 13/242 4/236
4,502,167 A * 3/1985 Porzelius ..... A47K 13/242 4/253
4,507,813 A * 4/1985 Lawson ..... A47K 13/242 292/210
4,524,470 A * 6/1985 Grenell ..... A47K 13/242 16/333
4,651,358 A * 3/1987 Logan, Jr. ..... A47K 13/242 16/333
4,724,551 A * 2/1988 Gardner ..... A47K 13/10 16/343
4,736,472 A * 4/1988 Buckshaw ..... A47K 13/242 292/210
D328,127 S 7/1992 Smith, Jr.
D338,823 S 8/1993 Johnson
5,347,663 A * 9/1994 Yost ..... A47K 13/242 292/219
D357,407 S 4/1995 Pate
5,405,003 A * 4/1995 Schmidt ..... B65D 73/0007 206/303
5,669,081 A * 9/1997 Scherer ..... A47K 13/24 4/253
5,933,875 A * 8/1999 Hulsebus ..... A47K 13/12 4/240
6,226,805 B1 * 5/2001 Watkins ..... A47K 13/24 4/253
6,371,543 B1 4/2002 Fujikawa
6,381,762 B1 * 5/2002 Moser ..... A47K 13/12 16/252
6,609,750 B1 8/2003 Cauduro
6,763,529 B1 * 7/2004 Richter ..... A47K 13/26 4/236
7,093,308 B2 8/2006 Berlovan et al.
D541,623 S 5/2007 Hord et al.
D583,221 S 12/2008 Johnsen
7,490,366 B1 * 2/2009 Richter ..... A47K 13/26 4/236
D622,575 S 8/2010 Li
8,214,931 B2 * 7/2012 Bemis ..... B29C 45/0081 4/236
8,495,768 B2 7/2013 Owen, Jr.
D705,043 S 5/2014 Michaud et al.
8,763,169 B2 7/2014 Daniels et al.
8,914,919 B1 * 12/2014 Schubert ..... A47K 13/242 4/253
9,107,547 B2 8/2015 Hand et al.
9,635,987 B2 5/2017 Hand et al.
D801,781 S 11/2017 Schuit et al.
2007/0017013 A1 1/2007 Pronovost
2009/0106884 A1 * 4/2009 Bemis ..... A47K 13/12 4/236
2013/0269092 A1 10/2013 Hand et al.
2020/0359810 A1 11/2020 Alt et al.
2021/0251441 A1 * 8/2021 Henne ..... F16B 31/021

* cited by examiner

DISPLAY MOUNT FOR TOILET SEAT ASSEMBLY

CROSS-REFERENCE TO RELATED APPLICATION

This application claims priority to U.S. Patent Application No. 62/847,671 filed May 14, 2019, the entire contents of which are incorporated herein by reference.

FIELD OF THE DISCLOSURE

The present disclosure relates to a toilet seat display within a store, and more particularly to a bracket coupled to the toilet seat display to support the toilet seat display on merchandise shelving.

SUMMARY

In one aspect, a display is configured to be coupled to a shelving structure. The display includes a bracket having an upper portion. The upper portion includes a plurality of walls defining a channel. The channel is configured to receive a member of the shelving structure to couple the bracket to the shelving structure. The bracket also includes a mounting portion extending below the upper portion. The mounting portion is configured to support a toilet seat assembly via a fastener secured to the mounting portion. The display also includes a lock member movably coupled to the mounting portion in a first position, in which the lock member is configured to secure the toilet seat assembly to the bracket, and in a second position, in which the lock member is configured to allow removal of the toilet seat assembly from the bracket while the fastener is secured to the mounting portion.

In another aspect, a display is configured to be coupled to a shelving structure. The display includes a toilet seat assembly and a bracket having an upper portion configured to be hooked on a member of the shelving structure to couple the bracket to the shelving structure. The bracket also includes a mounting portion cantilevered below the upper portion. The mounting portion includes a wall that supports the toilet seat assembly. The wall is positioned relative to the upper portion such that the mounting portion recesses at least a portion of the toilet seat assembly within the shelving structure.

In yet another aspect, a display is configured to be coupled to a shelving structure.

The display includes a bracket having an upper portion. The upper portion includes a plurality of walls. The plurality of walls is configured to contact a member of the shelving structure to couple the bracket to the shelving structure. The bracket also includes a mounting portion extending below the upper portion. The mounting portion includes a surface configured to be recessed within the shelving structure when the plurality of walls contact the member of the shelving structure. The mounting portion also includes an aperture extending through the surface. The aperture is positioned below the plurality of walls of the upper portion and configured to receive a fastener that couples a toilet seat assembly to the bracket.

In addition, other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and being practiced or being carried out in various ways. Also, it is to be understood that the phraseology and terminology used herein is for the purpose of description and should not be regarded as limiting. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
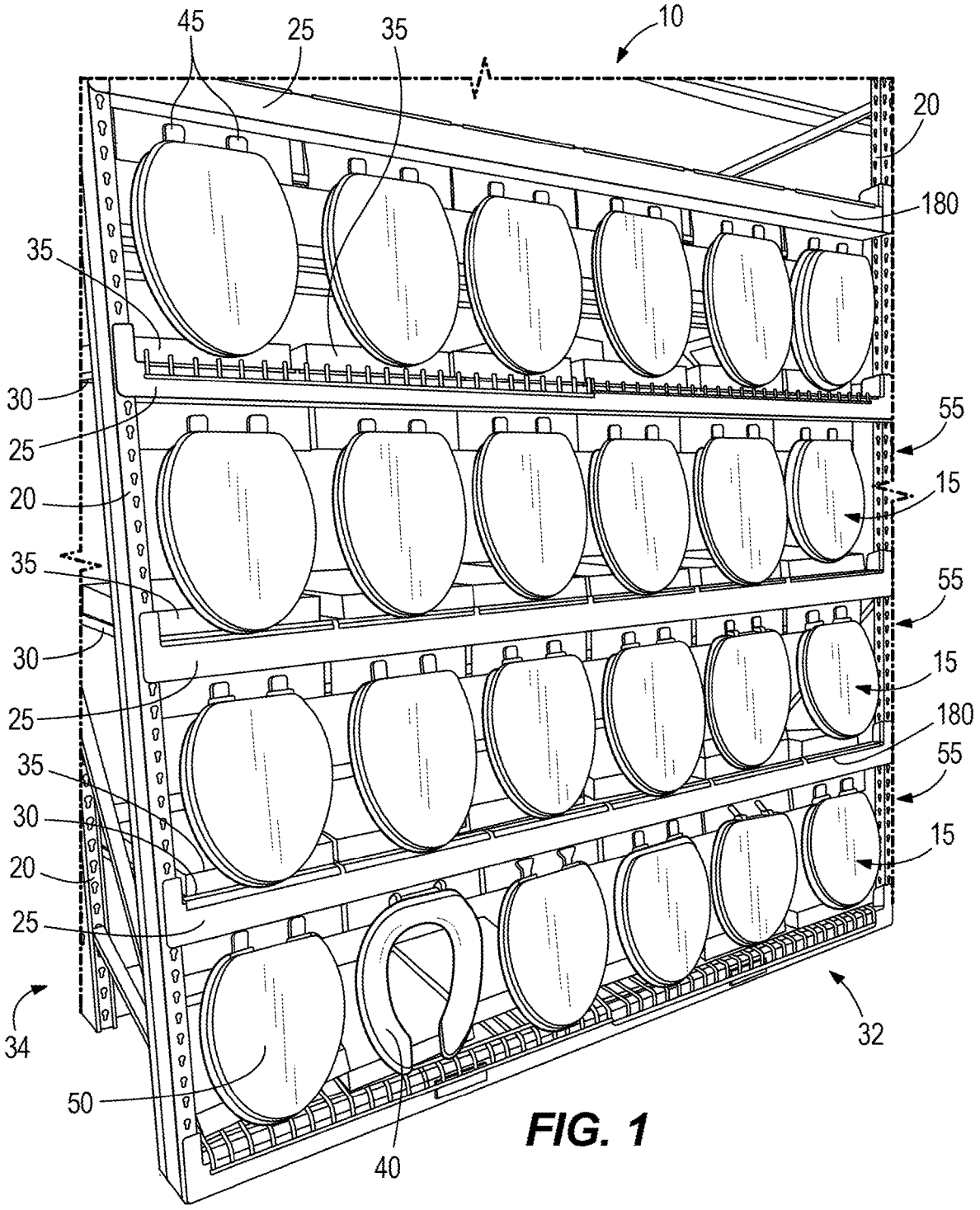
FIG. 1 is a perspective view of a shelving structure supporting a plurality of toilet seat displays.

FIG. 1 illustrates a merchandise shelving structure 10 located within a store (e.g., a home improvement store, hardware store, etc.). The shelving structure 10 supports a plurality of toilet seat assemblies 15 for display to customers within the store. The merchandise shelving structure 10, in one embodiment, includes a plurality of vertical members 20, a plurality of horizontal members 25 each coupled to at least two vertical members 20, and a support structure 30 (e.g., a wire grid, wood boards, etc.) coupled to a pair of horizontal members 25. In particular, the shelving structure 10 includes a front side 32 and a rear side 34 with the support structure 30 extended between the sides 32, 34. Packaged toilet seat assemblies 35 are supported on the support structure 30 behind a representative toilet seat assembly display 15 for a customer to purchase. The illustrated toilet seat assembly displays 15 include residential or commercial toilet seat assemblies having at least a toilet seat 40 and one or more hinge posts 45 pivotably coupled to the seat 40. The toilet seat assembly displays 15 can also include a lid 50 pivotably coupled to the hinge posts 45.

Figure 2:
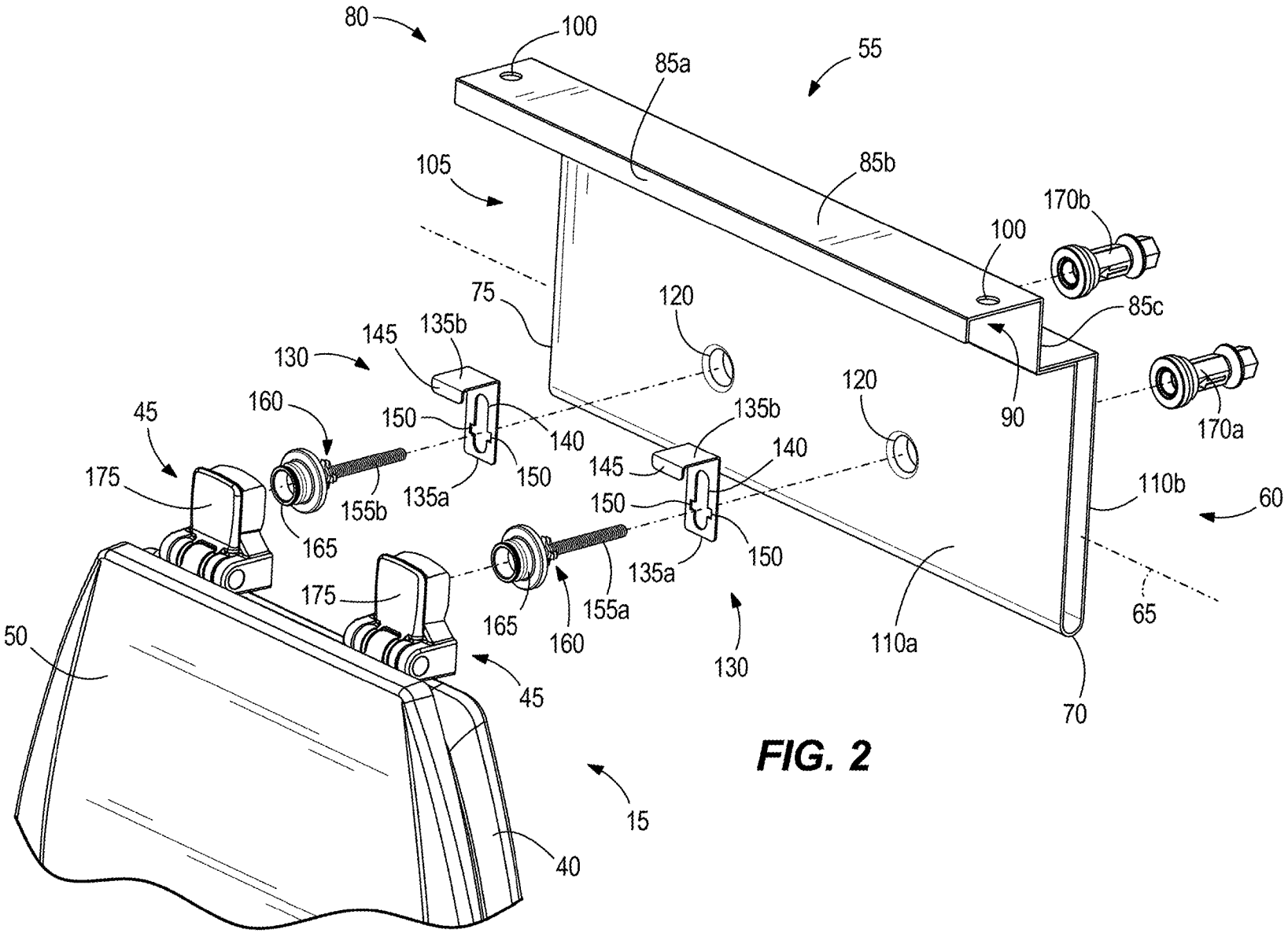
FIG. 2 is an exploded view of a mount assembly according to one embodiment of the disclosure that supports a toilet seat display on the shelving structure of FIG. 1.
Figure 3:
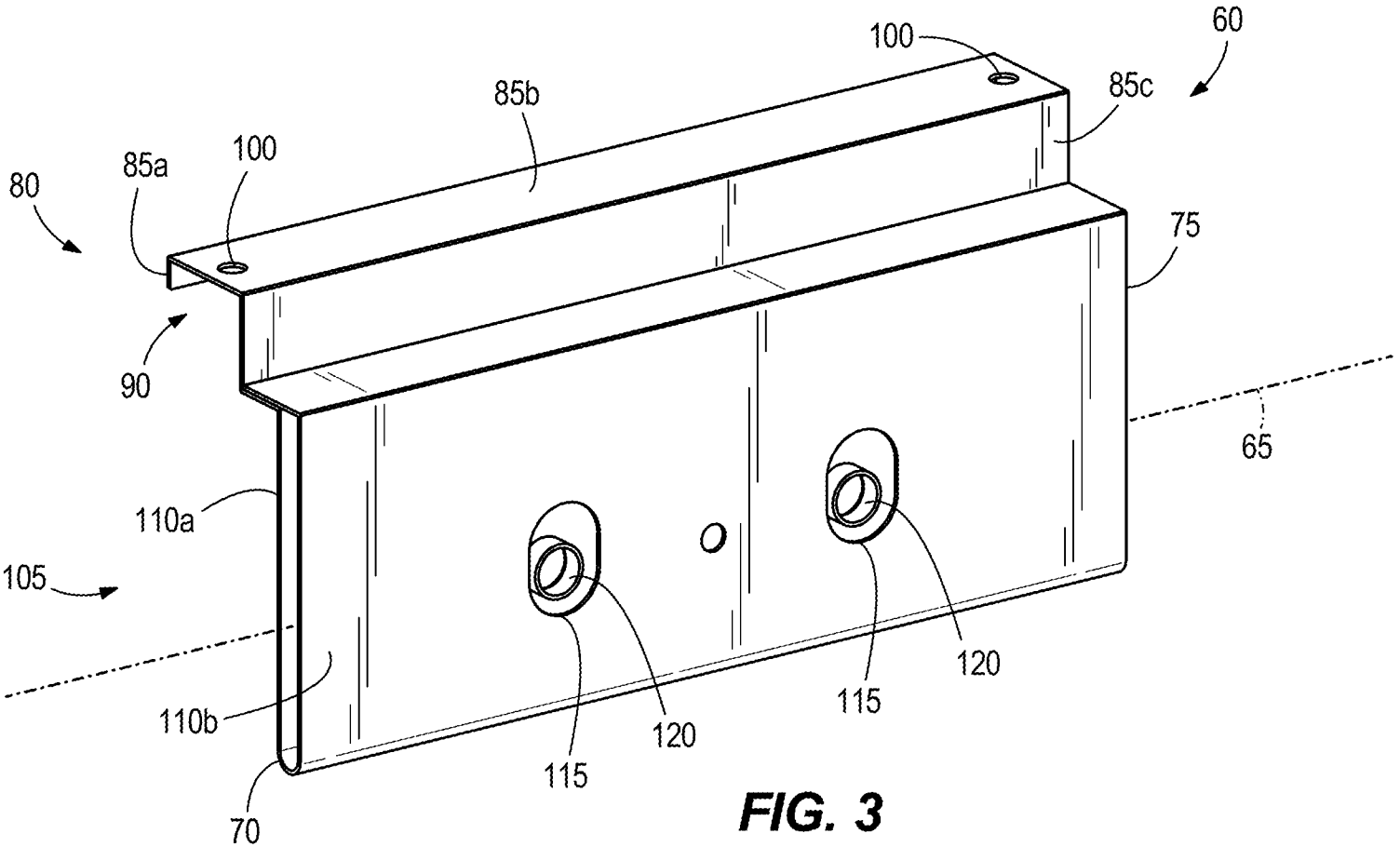
FIG. 3 is a rear view of a bracket of the mount assembly of FIG. 2.
Figure 4:
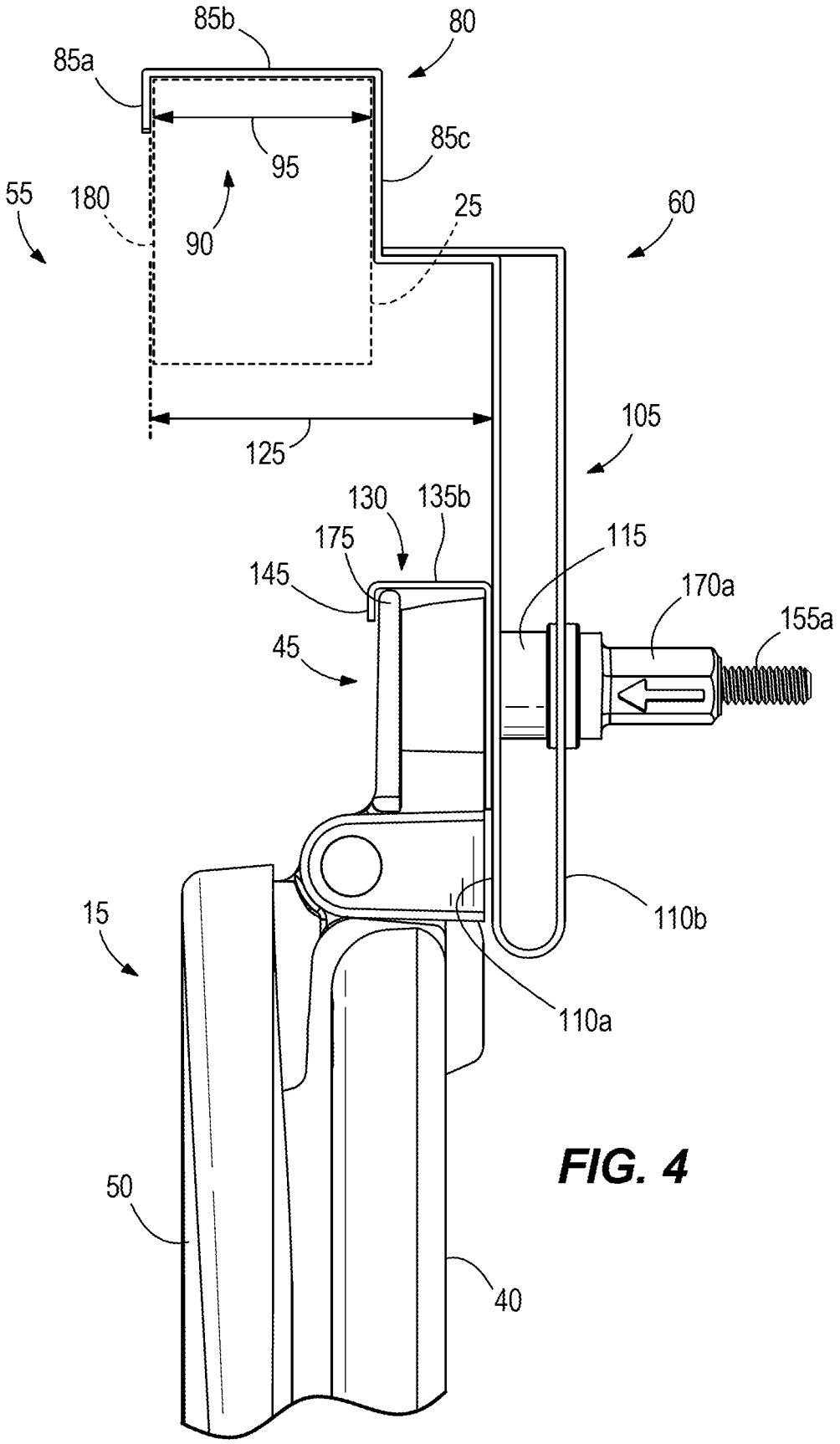
FIG. 4 is a side view of a toilet seat display hanging from the shelving structure of FIG. 1 by the mount assembly.

With reference to FIGS. 2-4, each display 15 is coupled to a mount assembly 55, with the mount assembly 55 coupled to one horizontal member 25 of the merchandise shelving 10. In other embodiments, one mount assembly 55 can support a plurality of displays 15. The illustrated mount assembly 55 includes a bracket 60 defining a longitudinal axis 65 that extends between first and second sides 70, 75 of the bracket 60. The bracket 60 includes an upper portion 80 having at least three walls 85*a*, 85*b*, 85*c* defining a channel 90 sized to receive a portion of one horizontal member 25 (FIG. 4). In the illustrated embodiment, the channel 90 has a U-shaped cross section that hooks onto the horizontal member 25 and has a width 95 (FIG. 4). The width 95 is measured transverse to the longitudinal axis 65 and substantially parallel to the top wall 85*b*. In some embodiments, the width 95 is between about 1.5 inches and about 2.0 inches.

In particular, the width 95 is about 1.8 inches. With reference to FIGS. 2 and 3, the upper portion 80 includes at least one mounting aperture 100 formed through the top wall 85*b*. The mounting aperture 100 is configured to receive a fastener (e.g., a screw, bolt, nail, pin, etc.) to secure the bracket 60 to the horizontal member 25. In the illustrated embodiment, the upper portion 80 includes two mounting apertures 100 adjacent opposite ends of the top wall 85*b*. In other embodiments, the mounting aperture(s) 100 can be omitted.

The bracket 60 also includes a mounting portion 105 extending below the upper portion 80. The mounting portion 105 is operable to couple the display 15 to the bracket 60. The illustrated mounting portion 105 includes a front wall 110*a*, a rear wall 110*b*, and flanges 115 coupled to the front wall 110*a* and extending rearward toward the rear wall 110*b*. The rear wall 110*b* is formed with the front wall 110*a* in a way to increase the rigidity of the mounting portion 105 to support the display 15, but in other embodiments, the rear wall 110*b* can be omitted. In addition, a display aperture 120 is formed through each flange 115 to extend between the front and rear walls 110*a*, 110*b*. With reference to FIG. 4, a distance 125—measured between the front wall 85*a* of the upper portion 80 and the front wall 110*a* of the mounting portion 105—transverse to the longitudinal axis 65 and substantially parallel to the top wall 85*b* is greater than the width 95 of the channel 90. In the illustrated embodiment, the distance 125 is between about 2.5 inches and about 3.0 inches. In other embodiments, the distance 125 is equal to or greater than about 2.8 inches. The distance 125 offsets the mounting portion 105 behind the upper portion 80 when the bracket 60 is hung from the shelving structure 10.

With reference back to FIG. 2, the mount assembly 55 also includes locking members 130 operable to secure the display 15 to the bracket 60. In the illustrated embodiment, the mount assembly 55 includes two locking members 130 (one for each display aperture 120). In other embodiments, the mount assembly 55 may only include one locking member 130 for one of the mounting apertures 120, or a single locking member 130 may span both mounting apertures 120. Each locking member 130 includes a first wall 135*a* having a slot 140 formed therethrough, a protruding wall 135*b* extending away from the first wall 135*a* (e.g., about 90 degrees relative to the first wall 135*a*), and a lip 145 extending from the protruding wall 135*b* (e.g., about 90 degrees relative to the protruding wall 135*b*). In other words, each locking member 130 is generally a hook-shaped locking member. In addition, the slot 140 of the first wall 135*a* includes two opposing notches 150 positioned between ends of the slot 140. In other embodiments, the notches 150 can be omitted.

To assemble the display 15 to the mount assembly 55 (FIG. 2), each bolt 155*a*, 155*b* of the display 15 (the bolts 155*a*, 155*b* which are conventionally received through mounting holes of a toilet bowl) is inserted through the slot 140 of a corresponding locking member 130. The illustrated bolts 155*a*, 155*b* include spaced protrusions 160 (e.g., four equally spaced protrusions around the bolt) adjacent a head 165 of each bolt 155*a*, 155*b* that are capable of conforming to various dimensions and shapes of the mounting holes of the toilet bowl.

However, during assembly of the display 15 to the mount assembly 55, two opposing protrusions 160 are received through the notches 150 such that the bolts 155*a*, 155*b* are unobstructed from being inserted through the slots 140. In embodiments where the bolts 155*a*, 155*b* do not include protrusions 160, the notches 150 can be omitted or go unused.

In addition, each bolt 155*a*, 155*b* is received through one display aperture 120 of the bracket 60 for a nut 170*a*, 170*b* to threadably engage a corresponding bolt 155*a*, 155*b*. By tightening the nuts 170*a*, 170*b*, the locking members 130 are clamped between the head 165 of a corresponding bolt 155*a*, 155*b* and the front wall 110*a* of the bracket 60. However, the clamping force is such to allow for slidable movement of the locking members 130 relative to the bolts 155*a*, 155*b*. In the illustrated embodiment, the nuts 170*a*, 170*b* abut a corresponding flange 115 (FIG. 4) to clamp the locking members 130 between the bracket 60 and the bolts 155*a*, 155*b*. In other embodiments, the flanges 115 can be internally threaded to engage the bolts 155*a*, 155*b*, thereby omitting the need for the nuts 170*a*, 170*b*.

Figure 5:
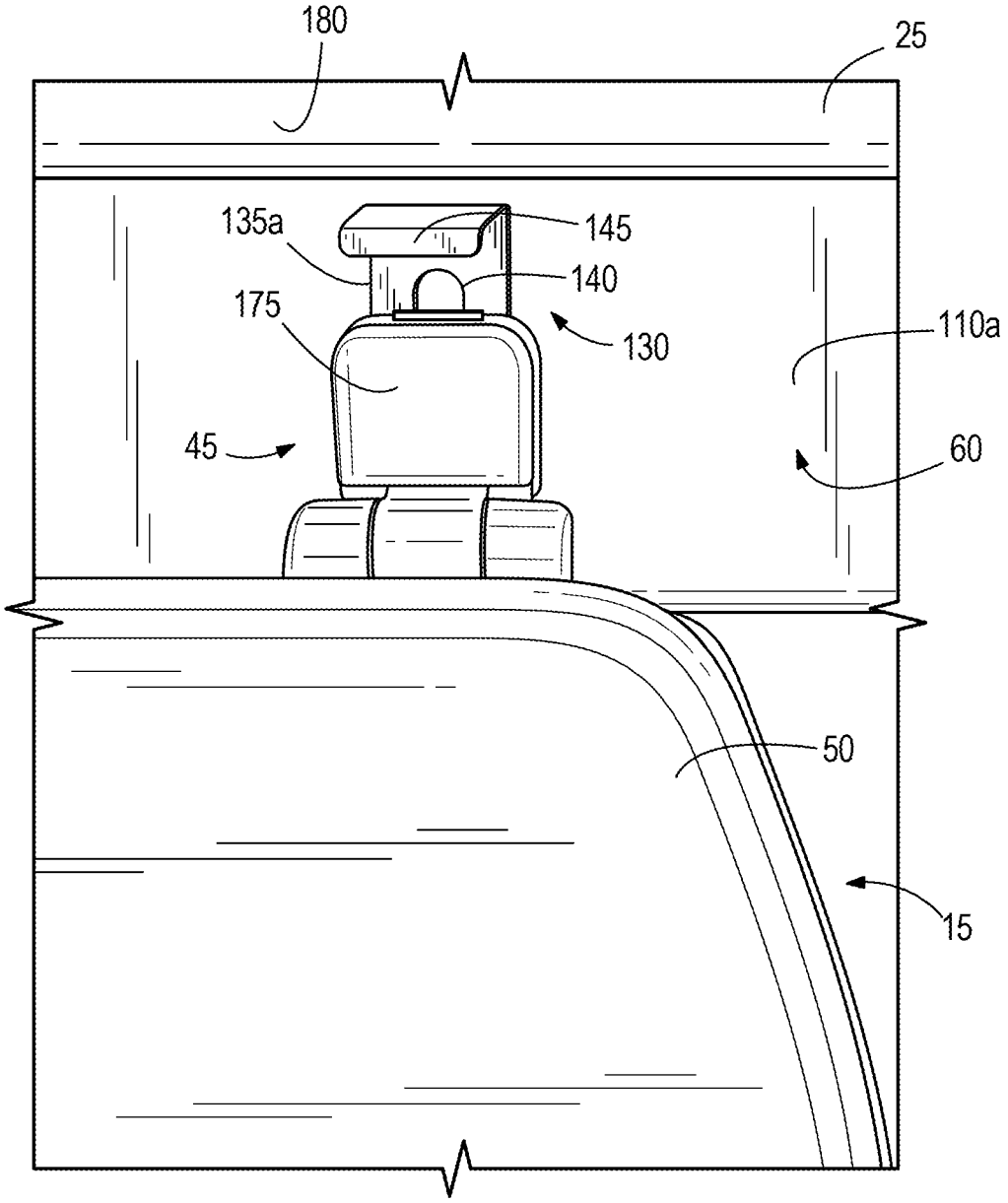
FIG. 5 illustrates a locking member of the mount assembly in an unlocked position, allowing the toilet seat display to be removed from the mount assembly.
Figure 6:
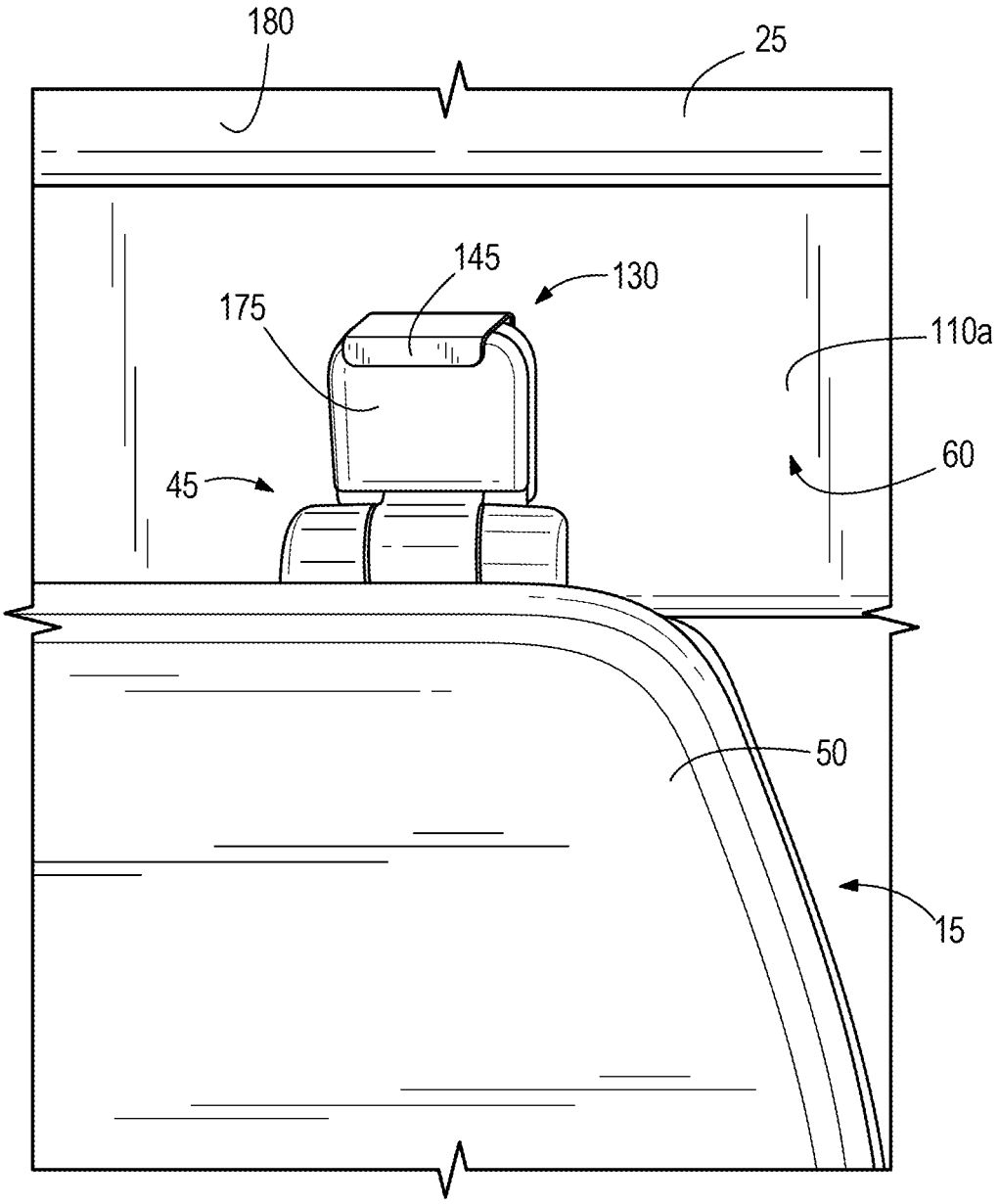
FIG. 6 illustrates the locking member of the mount assembly in a locked position, securing the toilet seat display to the mount assembly.

With reference to FIGS. 2 and 5, the hinge posts 45 are inserted onto the heads 165 of the bolts 155*a*, 155*b*, and quick-disconnect covers 175 of the hinge posts 45 are moved into a closed position to secure the toilet seat 40, the lid 50, and the hinge posts 45 to the bolts 155*a*, 155*b*—and ultimately the bracket 60. In some situations, a customer in the store may be able to easily remove the display 15 from the mount assembly 55 by moving the quick-disconnect covers 175 into an open position. As such, the locking members 130 are operable to maintain the quick-disconnect covers 175 in the closed position, inhibiting removal of the display 15 from the bracket 60. In particular, the locking members 130 are slidable into the hinge posts 45 such that the lip 145 of each locking member 130 overlaps with a corresponding quick-disconnect cover 175 (FIG. 6) to inhibit the quick-disconnect cover 175 from moving into the open position. In the illustrated embodiment, the lip 145 overlaps with a top edge of the cover 175; however, in other embodiments, the lock member 130 can be rotated 90-degrees such that the lip 145 overlaps with a side edge of the cover 175. In one embodiment, there are enough frictional forces between the bolts 155*a*, 155*b*, the locking members 130, and the front wall 110*a* such that the lips 145 remain over the hinge posts 45 when moved into the position shown in FIG. 6. In other embodiments, the nuts 170*a*, 170*b* can be further tightened onto the bolts 155*a*, 155*b* to further secure the locking members 130 in the position shown in FIG. 6. In other embodiments where the display 15 does not include quick-disconnect covers 175 on the hinge posts 45, the locking members 130 can be omitted or go unused.

With reference back to FIG. 4, the display 15 is hung on the merchandise shelving 10 by moving the bracket 60 over one horizontal member 25 such that a portion of the horizontal member 25 is received within the channel 90. The display 15 is cantilevered rearward from the upper portion 80 that couples the bracket 60 to the merchandise shelving 10. As shown in FIG. 4, the distance 125 allows the display 15 to be recessed within the merchandise shelving 10 (e.g., at least a portion of the display 15 is positioned between the front side 32 and the rear side 34 of the merchandise shelving 10). In the illustrated embodiment, the display 15 is recessed such that no portion of the display 15 extends forward beyond a front surface 180 (e.g., the front surface 180 defines a plane of the front side 32 of the shelving 10) of the horizontal member 25 and the front wall 85*a* of the upper portion 80 when the display 15 is hung on the shelving 10. In other embodiments, a relatively small portion of the display 15 may extend beyond the front surface 180 of the horizontal member 25, depending on the thicknesses of the seat 40 and the lid 50. Recessing the display 15 helps reduce the possibility of the display 15 from catching on machinery (e.g., a forklift, a ladder, etc.) moving past the merchandise shelving 10. In addition, the width 95 of the channel 90 is sized such that the bracket 60 is supported on the horizontal member 25 with the front wall 110*a* of the bracket 60 substantially parallel to the front surface 180 of the horizontal member 25 without the need for fasteners securing the bracket 60 to the horizontal member 25.

Furthermore, a plurality of brackets 60 can be horizontally aligned along the horizontal member 25 (to ensure the displays 15 are horizontally aligned) by inserting an elongate member (e.g., a dowel, a rod, etc.) between the front and rear walls 110*a*, 110*b* of each bracket 60 to ensure the elongate member contacts a bottom of each bracket 60.

The displays 15 can also be removed from their mount assembly 55 by using a tool (e.g., a screwdriver or the like) to move the locking members 130 into the unlocked position shown in FIG. 5. As such, the quick-disconnect covers 175 can be moved into the open position, and the display 15 can be removed from the mount assembly 55 for another display 15 to be coupled and secured to the mount assembly 55.

Although the disclosure has been described in detail with reference to certain preferred embodiments, variations and modifications exist within the scope and spirit of one or more independent aspects of the disclosure as described. Various features and advantages of the disclosure are set forth in the following claims.

The invention claimed is:

1. A display configured to be coupled to a shelving structure having a front side, a rear side, and a support structure connecting the front side and the rear side, the display comprising:

a bracket including an upper portion having a plurality of walls defining a channel, the channel configured to receive a member of the shelving structure to couple the bracket to the shelving structure, and a mounting portion extending below the upper portion and defining a front wall in facing relationship to the front side of the shelving structure and a rear wall in facing relationship to the rear side of the shelving structure, the mounting portion configured to support a toilet seat assembly via a fastener secured to the mounting portion; and a lock member movably coupled to the mounting portion in a first position, in which the lock member is configured to secure the toilet seat assembly to the bracket, and in a second position, in which the lock member is configured to allow removal of the toilet seat assembly from the bracket while the fastener is secured to the mounting portion, wherein the lock member is disposed adjacent the front wall of the mounting portion, and wherein the upper portion extends outward from the front wall of the mounting portion toward the front side of the shelving structure.

2. The display of claim 1, wherein the mounting portion is cantilevered from the upper portion.

3. The display of claim 1, wherein the lock member abuts a front surface of the mounting portion, wherein the front surface includes an aperture, wherein the lock member includes a slot, and wherein the aperture and the slot are configured to receive the fastener such that a portion of the lock member is coupled between the front surface of the mounting portion and a head of the fastener.

4. The display of claim 3, wherein the front surface is disposed on the front wall and the rear wall is spaced from the front wall, wherein the rear wall includes an aperture in alignment with the aperture of the front wall, and wherein the aperture of the rear wall is configured to receive the fastener.

5. The display of claim 1, wherein the lock member includes a lip, wherein the lip is configured to overlap a hinge post of the toilet seat assembly when the lock member is in the first position, and wherein the lip is configured to be spaced from the hinge post of the toilet seat assembly when the lock member is in the second position.

6. The display of claim 5, wherein the lock member is a hooked shaped lock member.

7. The display of claim 1, wherein the lock member is a first lock member, wherein the display further comprises a second lock member movably coupled to the mounting portion independently from the first lock member, wherein the second lock member is moveable between a first position, in which the second lock member is configured to secure the toilet seat assembly to the bracket, and a second position, in which the second lock member is configured to allow removal of the toilet seat assembly from the bracket.

8. A display configured to be coupled to a shelving structure, the display comprising:

a toilet seat assembly; and a bracket including an upper portion having a channel that is configured to be hooked on a member of the shelving structure to non-rotatably couple the bracket to the shelving structure, and a mounting portion cantilevered below the upper portion and defining a longitudinal axis that is parallel to the channel, the mounting portion having a wall that supports the toilet seat assembly, the wall positioned relative to the upper portion such that the mounting portion recesses at least a portion of the toilet seat assembly within the shelving structure.

9. The display of claim 8, further comprising a lock member movably coupled to the mounting portion in a first position, in which the lock member secures the toilet seat assembly to the bracket, and in a second position, in which the lock member allows removal of the toilet seat assembly from the bracket.

10. The display of claim 9, wherein the wall of the mounting portion includes an aperture, wherein the lock member includes a slot, and wherein the aperture and the slot are configured to receive a fastener that supports the toilet seat assembly on the mounting portion such that a portion of the lock member is coupled between the wall of the mounting portion and a head of the fastener.

11. The display of claim 10, wherein the wall is a front wall of the mounting portion, wherein the mounting portion includes a rear wall spaced from the front wall, wherein the rear wall includes an aperture in alignment with the aperture of the front wall, and wherein the aperture of the rear wall is configured to receive the fastener.

12. The display of claim 9, wherein the lock member includes a lip, wherein the lip overlaps a hinge post of the toilet seat assembly when the lock member is in the first position, and wherein the lip is spaced from the hinge post of the toilet seat assembly when the lock member is in the second position.

13. The display of claim 12, wherein the lock member is a hooked shaped lock member.

14. The display of claim 9, wherein the lock member is a first lock member, wherein the display includes a second lock member movably coupled to the mounting portion independently from the first lock member, wherein the second lock member is moveable between a first position, in which the second lock member secures the toilet seat assembly to the bracket, and a second position, in which the second lock member allows removal of the toilet seat assembly from the bracket.

15. A display configured to be coupled to a shelving structure having a front side, a rear side, and a support structure connecting the front side and the rear side, the display comprising:

a bracket including an upper portion having a plurality of walls, the plurality of walls configured to contact a member of the shelving structure to couple the bracket to the front side of the shelving structure, and a mounting portion extending below the upper portion, the mounting portion having a surface and an aperture extending through the surface, the aperture positioned below the plurality of walls of the upper portion and configured to receive a fastener that couples a toilet seat assembly to the bracket, wherein the mounting portion is cantilevered from the upper portion in a direction from the front side toward the rear side, such that no portion of the toilet seat assembly extends beyond the upper portion.

16. The display of claim 15, further comprising a lock member movably coupled to the mounting portion in a first position, in which the lock member is configured to secure the toilet seat assembly to the bracket, and in a second position, in which the lock member is configured to allow removal of the toilet seat assembly from the bracket.

17. The display of claim 16, wherein the lock member includes a slot, and wherein the slot is configured to receive the fastener such that a portion of the lock member is coupled between the surface of the mounting portion and a head of the fastener.

18. The display of claim 15, wherein the mounting portion includes a front wall having the surface, wherein the mounting portion includes a rear wall spaced from the front wall, wherein the rear wall includes an aperture in alignment with the aperture of the front wall, and wherein the aperture of the rear wall is configured to receive the fastener.

19. The display of claim 16, wherein the lock member includes a lip, wherein the lip is configured to overlap a hinge post of the toilet seat assembly when the lock member is in the first position, and wherein the lip is configured to be spaced from the hinge post of the toilet seat assembly when the lock member is in the second position.

20. The display of claim 19, wherein the lock member is a hooked shaped lock member.

* * * * *